US008459570B2

(12) United States Patent
Stefanutti

(10) Patent No.: US 8,459,570 B2
(45) Date of Patent: Jun. 11, 2013

(54) SUPPORTING ARRANGEMENT

(75) Inventor: Rino Stefanutti, Madrid (ES)

(73) Assignee: Petrucco, S.A., Madrid (ES)

( * ) Notice: Subject to any disclaimer, the term of this patent is extended or adjusted under 35 U.S.C. 154(b) by 193 days.

(21) Appl. No.: 12/804,812

(22) Filed: Jul. 29, 2010

(65) Prior Publication Data

US 2012/0024970 A1 Feb. 2, 2012

(51) Int. Cl.
*E01B 3/00* (2006.01)

(52) U.S. Cl.
USPC ..... 238/26

(58) Field of Classification Search
USPC ..... 238/24–30, 40, 42, 50, 51, 287, 288, 238/292, 310
See application file for complete search history.

(56) References Cited

U.S. PATENT DOCUMENTS 1,674,281 A * 6/1928 Fleming ..... 261/114.1
5,605,281 A * 2/1997 Benenowski et al. ..... 238/26

* cited by examiner

*Primary Examiner* — R. J. McCarry, Jr.
(74) *Attorney, Agent, or Firm* — Paul Bogdon

(57) ABSTRACT

Supporting arrangement intended to be arranged in a shoring zone of railway lines (17), where at least first longitudinal metal beams (12) are arranged parallel to a line of the track on the outer side of each track line (17) so that they are braced by at least one second perpendicular metal beam (14) with a length less than that of the first longitudinal beams (12) and the joining of each longitudinal beam (12) to one end of the perpendicular beam (14) is performed by means of a mechanical fixing means (15).

5 Claims, 7 Drawing Sheets

SUPPORTING ARRANGEMENT

FIELD OF THE INVENTION

The present invention relates, generally, to a method for carrying out construction work underneath roadways or railways without interrupting the traffic.

More specifically, the present invention relates to a method for eliminating road and railway line intersections by providing a bottom passage structure outside of its final location and arranging it in position by means of displacement or thrusting of inserted caisson elements, while ensuring continuous communication above the intersection.

STATE OF THE ART

It is known in the state of the art to eliminate an intersection level crossing by means of the prefabricated construction of a bottom passage underneath the intersection and its installation using the thrusting or inserted caisson technique.

Elimination of the level crossing at an intersection comprises at least the following operations: manufacture and arrangement of the caisson, provision of a receiving surface, after construction of the caisson outside of its final location, which is as close as possible to the final receiving surface for the inserted caisson, in order to reduce the distance which the caisson must travel and in any case must be equal to the length of the caisson plus the space needed to house the thrusting wall or reaction wall for the thrusting forces and the hydraulic thrusting jacks.

After performing the aforementioned tasks which will be performed by means of the method which is most suitable in each case and which will be determined by the ground and space available, the next step involves construction of a reinforced-concrete sliding sill, with lateral guiding rails at the base of the caisson, the function of which will be to prevent lateral displacement of the caisson.

The sill has a dual function: on the one hand to create a sliding surface for the caisson and, on the other hand, to act as a formwork for the construction of the associated caisson.

At the most distant end of the intersection the reaction wall intended to withstand the thrust of the hydraulic jacks is constructed.

In each case, the dimensions of both the sill and the reaction wall and the number of jacks depend on the weight of the caisson to be pushed into position.

Once the wall and sill have been constructed and after the setting time for the concrete used, a sheet of polyethylene or similar material of a certain thickness is extended over the latter, this having the function moreover of separating the sill of the caisson which is to be constructed from the sliding sill and reducing horizontal friction during displacement, which is of fundamental importance during the initial stage thereof.

During the forward thrusting operation it is necessary to move the support point of the hydraulic jacks, namely construct successive counter thrusting slabs depending on the displacement of the caisson. The function of the counter thrusting slabs is to ensure correct transmission of the force.

The slabs of the highly reinforced constructed caisson have different functions: the bottom one for supporting a travel way allowing the passage of vehicles, trains, pedestrians, etc., and the top one for supporting the traffic of vehicles, trains, pedestrians, etc.

The caisson has a form with a number of rib-like ties at the front thereof, the purpose of which is to provide the least possible resistance to the forward movement against the ground and secure it laterally, for which reason said stirrups are chamfered in their plane of contact with the ground; at the top thereof it has a number of auxiliary beams, the function of which is to brace the ribs and act as a support point for the maneuvering beams.

The inclination of the ribs is determined depending on the angle of contact of the ground and the need to ensure almost simultaneous contact of the ribs and the bottom slab with the ground.

The support beam situated at the front end of the ribs and seated inside the grooves of both ties has the function of providing a support for transverse metal sections which are arranged underneath the sleepers and in the thrusting direction. Generally the transverse supports are composed of fastened pairs of beams of the IPN type in the form of a "II" which are arranged depending on the slant and separated from each other 1.20 m to 2.40 m between the axes. Usually several pairs of fastened sections are mounted above the caisson.

The transverse support, i.e. fastened sections, have the function of supporting the associated track and transmitting the loads of the rolling stock which travel on the rails and create a surface below which the caisson is slid.

In order to ensure sliding between caisson and fastened sections, round members are arranged between the latter and the top of the caisson in order to facilitate said sliding movement and the fastened sections are braced at the start of the thrusting movement so that they are not subject to any movement with the continuous displacement of the caisson.

Sometimes it is necessary to position wood wedges between the transverse supports and the cross ties, these having the function of ensuring the correct level or elevation of the track during insertion of the caisson.

Moreover, longitudinal shoring is provided above each railway track, consisting in arranging a pair of sets or series of tracks parallel to each track line, fixed by a clamp on both sides of the track line and braced by a number of perpendicular sections or tracks which fix together both sets, supporting at the same time the load of the tracks at the moment when, for working requirements, the support provided by the ballast is no longer present.

Therefore it is required to develop a method for insertion of a caisson which allows the trains to pass through more rapidly than hitherto while displacement of the caisson from the construction location to its final location is being performed, forming a lower passage of a railway line.

EP 1 621 671 A2 discloses a modular system for provisionally supporting working railway tracks during under-track works. In order to carry out infrastructures such as underpasses under the railway tracks a number of rails are arranged in a parallel arrangement with respect to the railway track, the rails being inferiorly connected to each other by a transversal rail section, this system being nevertheless hard to implement and lacking in solidity. The modular system of the invention comprises a plurality of loadbearing crossbeams being arranged in an inferior and transversal arrangement with respect to the railway track rails, the loadbearing crossbeams being parallel to the crossties, and a number of pairs of longitudinal staying beams being arranged in a parallel arrangement with respect to the railway track rails in the middle area between them and at both their sides, said staying beams resting on the plurality of loadbearing crossbeams, the loadbearing crossbeams and the staying beams being joined together by means of lowerable steel blocks.

In the same way, DE 1 205 575 B and ES 2 151 364 A1 disclose supporting arrangement intended to be arranged in a shoring zone of railway track where number of rails are arranged in a parallel arrangement with respect to the railway track, the rails being inferiorly connected to each other by a transversal rail section.

SUMMARY OF THE INVENTION

The present invention aims to eliminate or palliate one or more of the abovementioned drawbacks by means of a supporting arrangement as claimed in claim 1. Embodiments of the invention are defined in the dependent claims.

One object of the invention is to provide a shoring system for railway lines in the insertion zone which avoids the use of transverse supports, or fastened sections, above the top part of a caisson which is being inserted in position.

Another object of the invention is to avoid the installation of the longitudinal shoring assemblies which are at present used, assembly and disassembly of which is relatively time-consuming.

Another object of the invention is to provide a self-supporting shoring arrangement which avoids interruption of the railway traffic during assembly and disassembly thereof.

Yet another object of the invention is to reduce the duration of the process for moving the caisson since the railway track is self-supporting and the installation of transverse supports above the top part of the caisson is not required. As a result, the completion times for the whole work are reduced.

BRIEF DESCRIPTION OF THE DRAWINGS

A more detailed explanation of the invention is provided in the following description based on the accompanying drawings in which.

DESCRIPTION OF THE INVENTION

Figure 1:
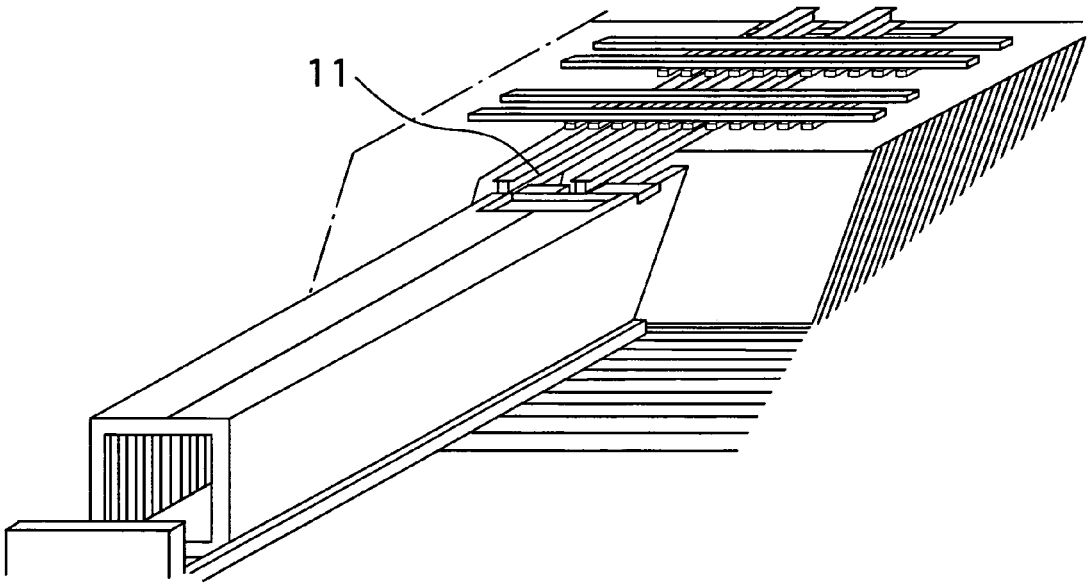
FIG. 1 Prior Art
FIG. 1 illustrates the process for insertion of a caisson according to the state of the art.

Below, with reference to FIG. 1, a process for inserting a caisson is shown, it being possible to see the transverse support 11, i.e. fastened sections 11 which have the function of supporting the associated track and transmitting the loads of the rolling stock travelling on the rails and creating a surface below which the caisson is slid.

One of the advantages of the present invention consists in the elimination of the fastened sections 11 of metal beams, which ensures at all times correct positioning of the railway track, below which construction of a passage below the railway is performed.

Figure 2:
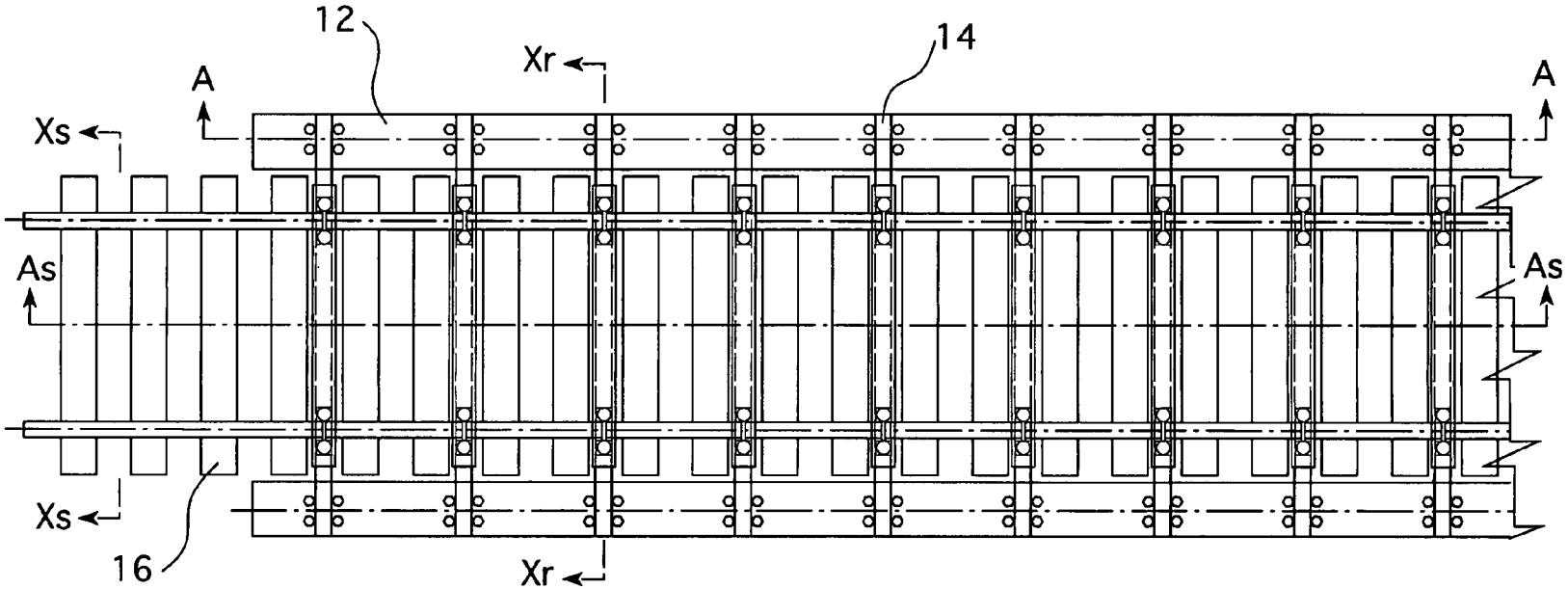
FIG. 2 shows a plan view of an arrangement for supporting the railway track according to the invention.

With reference now to FIG. 2, the shoring arrangement according to the invention comprises first metal shoring beams 12, a first longitudinal metal beam 12 arranged parallel to a line 17 of the track on the outer side of the track line 17, that is, between the two track lines 17 there is no longitudinal beam 12 installed.

The set of first longitudinal beams 12 is braced by a second set of perpendicular metal beams 14, with a length less than the first longitudinal beams 12, which fix together both first longitudinal beams 12. Joining of each first longitudinal beam 12 to a second beam 14 is performed via a mechanical fixing means 15 such as a tie, flange, clamp or the like (see FIG. 3).

The fixing system 15 has the function of joining one end of the second beam 14 to a first longitudinal beam 12 on the outer side of the railway line 17. Consequently travel of the trains through the shoring zone is not necessary since, in order to perform the shoring work before insertion of the caisson, it is not necessary to occupy the space between railway lines 17.

Figure 3:
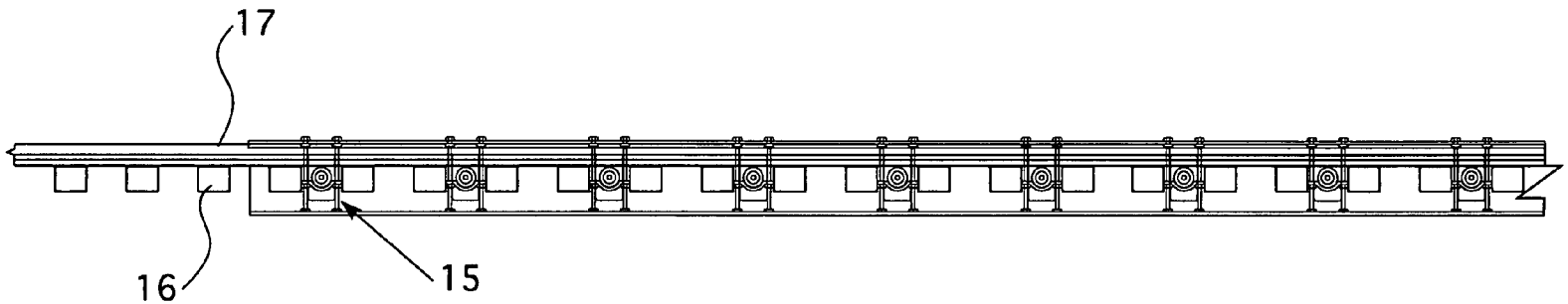
FIG. 3 shows an elevation view of a longitudinal section of FIG. 2 according to the invention.
Figure 5:
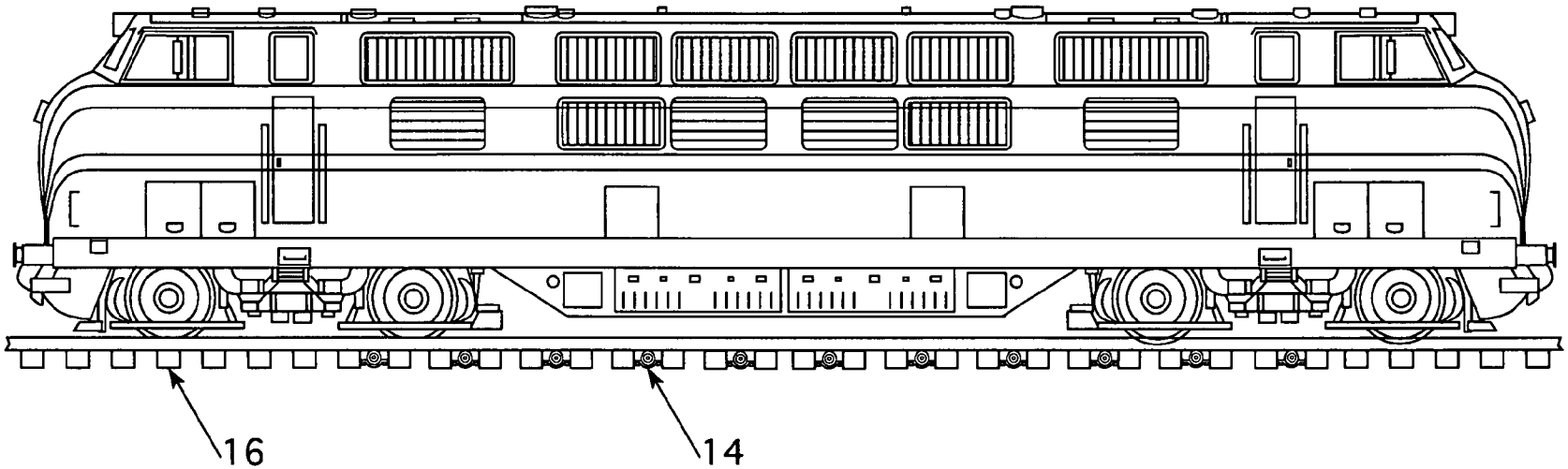
FIG. 5 shows an elevation view of a longitudinal section along the axis As-As of FIG. 2 according to the invention.

With reference now to FIGS. 2, 3 and 5, the second perpendicular metal beam 14 is installed between two sleepers 16 and generally in the direction of thrusting of the inserted caisson.

The spacing between two second perpendicular beams 14 will correspond to a minimum distance substantially equivalent to the width of a sleeper 16 and a predetermined maximum distance corresponding to the width of several sleepers 16 and the spacing between the sleepers will be based on the rolling stock travelling along the tracks.

Where necessary it is possible to add wedges to the second perpendicular beams 14 in order to maintain the elevation of the track in the shoring zone.

With reference now to FIGS. 2, 3, 5, 6 and 8, the fixing system 15 which joins one end of the second beam 14 to the first longitudinal beam 12 will be described.

Figure 4:
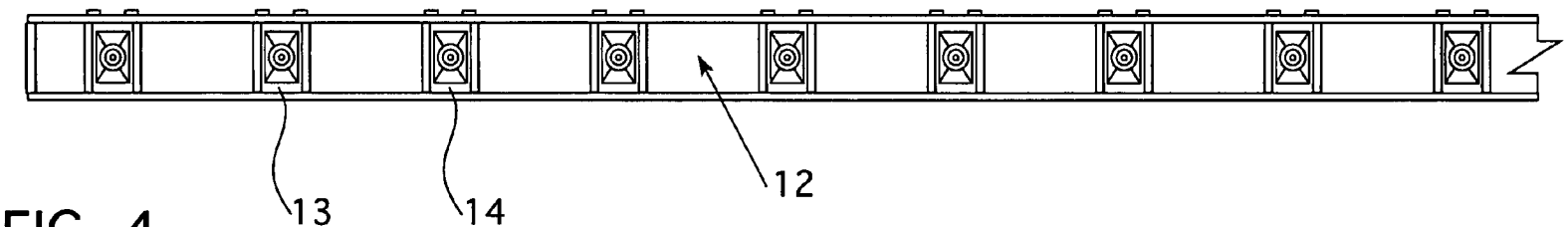
FIG. 4 shows an elevation view of a longitudinal section along the axis A-A of FIG. 2 according to the invention.
Figure 7:
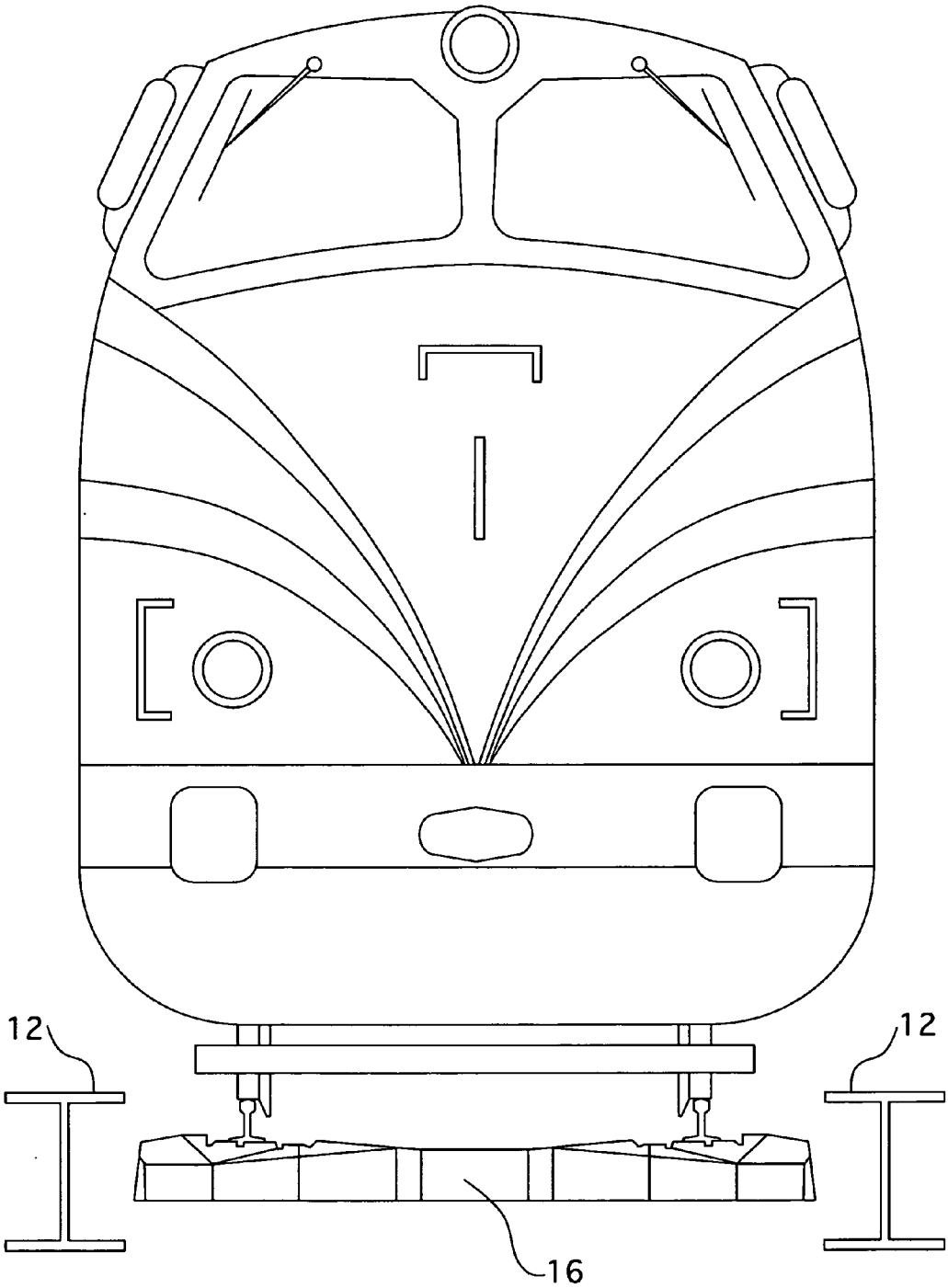
FIG. 7 shows an elevation view of the cross-section along the axis Xs-Xs of FIG. 2 according to the invention.

Preferably, the first longitudinal metal beam 12 may be a hollow beam, having cavities 13 which may be circular, hexagonal, octagonal or the like, or a beam of the type with an H or double T profile, with flanges which are wide enough so that it is possible to form in the flanges sets of parallel through-holes and in which the holes of one flange are aligned with the holes of the other opposite flange (see FIGS. 3, 4 and 7).

In this latter case cavities 13 will be formed, spaced from each other on the basis of the distance separating, from each other, the second perpendicular beams 14 which brace the first longitudinal beams 12.

Figure 8:
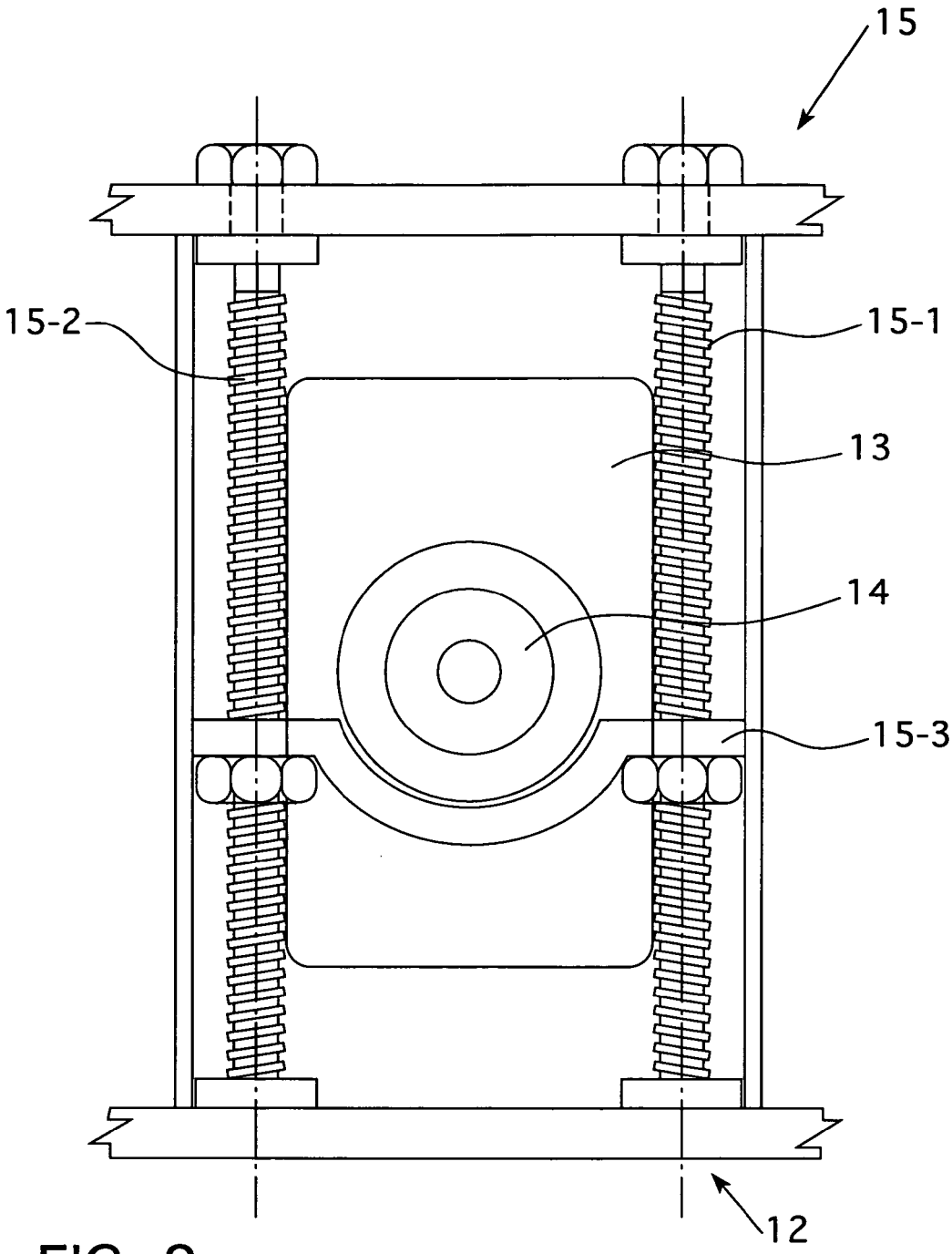
FIG. 8 shows an elevation view of a mechanical fixing means according to the invention.

The cross-section of the cavities 13 to be formed will depend on the cross-section of the second perpendicular beam 14 which braces the first longitudinal beams (see FIG. 8).

Figure 6:
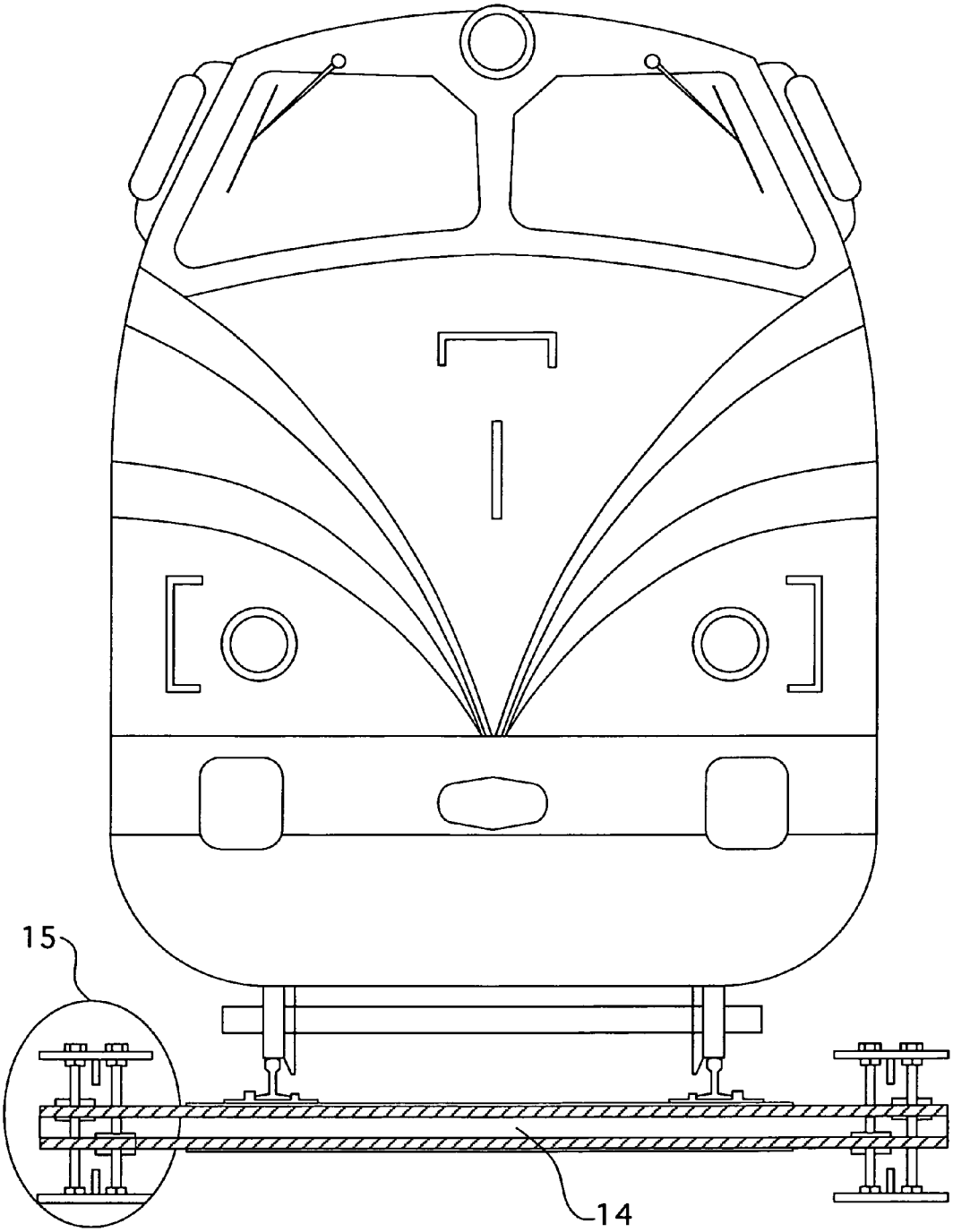
FIG. 6 shows an elevation view of the cross-section along the axis Xr-Xr of FIG. 2 according to the invention.

With reference now to FIGS. 6 and 8, the sets of through-holes are formed in both flanges on both sides of part of the section which has the cavities 13, so that first through-bars 15-1, 15-2 pass through the holes situated in parallel flanges so that a second bar 15-3 perpendicular to the first bars 15-1, 15-2 may be fixed against one end of the second beam 14 and therefore the second beam 14 is fastened by the arrangement 15 of first bars 15-1, 15-2 and second bars 15-3 each situated on one side of the hollow section 12 (see FIGS. 3 and 6).

The length of the shoring arrangement must be such as to allow the excavation necessary for displacement of the caisson to be inserted. Consequently, in order to achieve the aim of supporting the track and transmitting the loads travelling along the rails it is possible to position adjacent various shoring arrangements as described above, since in order to obtain the best possible result the length of the first longitudinal beams 12 corresponds to a predetermined maximum length.

The embodiments and examples described in this document are intended to provide the best explanation of the present invention and its practical implementation and allow in this way persons skilled in the art to put into practice and use the invention. Nevertheless, persons skilled in the art will recognize that the description and the above examples have been provided for the purposes of illustration and solely by way of example. The description as provided is not intended to be exhaustive or to limit the invention to the precise embodiment described. Many modifications and variations are possible on the basis of the above teaching without departing from the underlying principle and scope of the following claims.

The invention claimed is:

1. A supporting assembly being arranged in a shoring zone of parallel railway tracks supported on generally parallel sleepers, the supporting assembly comprising:

a pair of elongated longitudinal metal first beams each formed of interconnected flanges and a web, one each of said first beams being arranged generally parallel to and on the outer side of each railway track;

said web of each first beam defining a cavity there through;

a perpendicular metal second beam disposed beneath and in engagement with the underside of sections of each railway track with the opposite end sections of said second beam inserted in and passing through said cavities of said web of opposite each of said first beams;

mechanical fixing means in engagement with each of said first beams and said second beam for firmly securing said first beams and said second beams to each other;

wherein said second beam is arranged to engage the webs of each of said of each of first beams;

wherein said mechanical fixing means includes a pair of at least two holes disposed through each side of one of said flanges of both of said first beams;

wherein said mechanical fixing means includes at least one elongated first bar with one end thereof running through one of said holes in said flange with the opposite end of said first bar engaging the opposite flange; and wherein said mechanical fixing means also includes adjustable means on said first bar engaging said second beam for securing said second beam to said web of said first beam.

2. The supporting assembly as set forth in claim 1 wherein said second beam is arranged between two generally parallel sleepers.

3. The supporting assembly as set forth in claim 1 wherein each of said first beams is a cellular beam selected from the group consisting of I, double T or H-shaped cross sections.

4. The supporting assembly as set forth in claim 1 wherein said mechanical fixing means includes an elongated second bar generally parallel and spaced from a said first bar with one end of said second bar extending through the other of said holes in said flange and secured thereto and the opposite end of said second bar engaging the opposite of said flange; at least one support member extending between said second bar engaging a portion of said second beam; and wherein said adjustable means engages both of said first and second bar and said second beam for securing said first and second beams to each other.

5. The support assembly as set forth in claim 4 wherein said mechanical fixing means includes a tie, third flange, and clamp.

* * * * *